US007225912B1

(12) United States Patent
Toennisson et al.

(10) Patent No.: US 7,225,912 B1
(45) Date of Patent: Jun. 5, 2007

(54) ESCALATOR WHEEL MONITOR

(75) Inventors: H. Eugene Toennisson, Hamilton, OH (US); Kyle A. Apperson, Maineville, OH (US); Mark T. Davidson, Mason, OH (US); Dustin J. Charville, Mainville, OH (US); John D. Shupe, Lebanon, OH (US); Masashi Tsuchihata, Osaka (JP)

(73) Assignee: FujiTec America Inc., Lebanon, OH (US)

( * ) Notice: Subject to any disclaimer, the term of this patent is extended or adjusted under 35 U.S.C. 154(b) by 149 days.

(21) Appl. No.: 11/065,414

(22) Filed: Feb. 24, 2005

Related U.S. Application Data

(60) Provisional application No. 60/548,148, filed on Feb. 26, 2004.

(51) Int. Cl.
*B66B 29/00* (2006.01)
*B66B 21/02* (2006.01)

(52) U.S. Cl. ..... 198/323; 198/810.03

(58) Field of Classification Search ..... 198/322–323, 198/810.03
See application file for complete search history.

(56) References Cited

U.S. PATENT DOCUMENTS 5,096,040 A * 3/1992 Wente et al. ..... 198/323
5,236,075 A * 8/1993 Bartmann ..... 198/323
5,361,887 A * 11/1994 Zaharia et al. ..... 198/323
5,819,902 A * 10/1998 Schoneweiss et al. ..... 198/323

FOREIGN PATENT DOCUMENTS

JP 53140788 A * 12/1978

* cited by examiner

*Primary Examiner*—Mark A. Deuble
(74) *Attorney, Agent, or Firm*—Frost Brown Todd LLC

(57) ABSTRACT

The present invention teaches a mechanical device that monitors the support wheels, or rollers, of a moving escalator stair step. The diameter of each support wheel is indirectly measured by determining the height of each support wheel axial above a given plane. Support wheels that have unacceptable diameter trip an activation mechanism that sends an electrical signal to stop the escalator's driving motor.

8 Claims, 6 Drawing Sheets

ESCALATOR WHEEL MONITOR

RELATED APPLICATIONS

This application claims the priority of U.S. Provisional Patent Application Ser. No. 60/548,148 filed on Feb. 26, 2004, titled "Escalator Wheel Monitor."

BACKGROUND OF THE INVENTION

The present invention generally relates to people moving escalators and/or other people moving walkways. More particularly the present invention relates to a method and apparatus for detecting and identifying damaged or missing support wheel rollers.

Although the embodiment described and taught herein refers to the present invention being used on a rising, or descending, stair escalator, it is to be understood that the present invention may also be used on any closed loop, continuously moving apparatus employing continuously rolling wheels subject to undetected damage and/or ware.

Escalators and similar conveyor-type devices, typically incorporate a closed loop, continuous, series of moving platforms, or belts, guided and/or supported upon a closed loop track by rolling wheels or rollers, which move along the closed loop track. Since this type of people mover, or conveyor, operates continuously, the rollers are subject to continuous wear. Because of degradation of the rollers from continuous operational ware, and/or other roller damage, it is necessary to frequently inspect the rollers for operational ware, and/or other types of damage. In addition to scheduled inspections of the rollers, it is desirable to have means to continuously monitor the rollers to detect abnormal wear and/or damage that may occur between scheduled inspections.

SUMMARY OF THE INVENTION

The present invention teaches a continuously operating mechanical apparatus for detecting supporting rollers, or wheels, of an escalator stair step, which may have experienced undetected operational roller wear, beyond a predetermined limit, unexpected damage to the roller through operational use, or detecting a completely missing roller.

The apparatus taught herein comprises a pivoting actuator assembly attached to the return tracks of the escalator. The actuator is mounted directly to the roller track and may be part of the original installation or may be easily retrofitted to existing escalators.

The present invention discloses a mechanical apparatus which continually monitors the support rollers of escalators and other similar conveyor devices including means for stopping the escalator when a defective roller is detected.

DETAILED DESCRIPTION OF THE INVENTION

Structural Configuration of the Escalator Roller Monitor.

Figure 1:
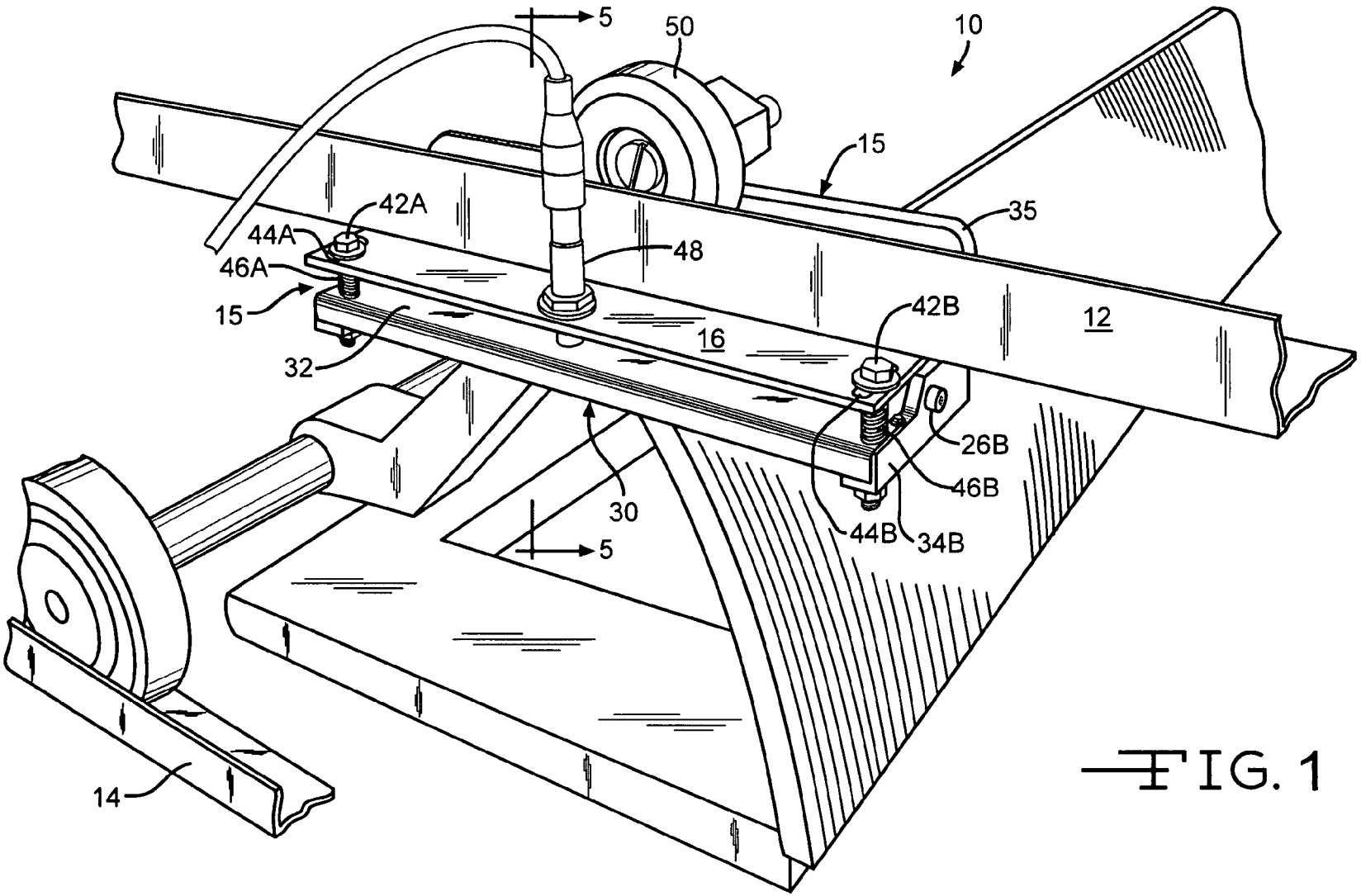
FIG. 1 presents a pictorial view of an escalator roller monitoring device attached to the return rail, or track, of a typical escalator and embodying the present invention.
Figure 2:
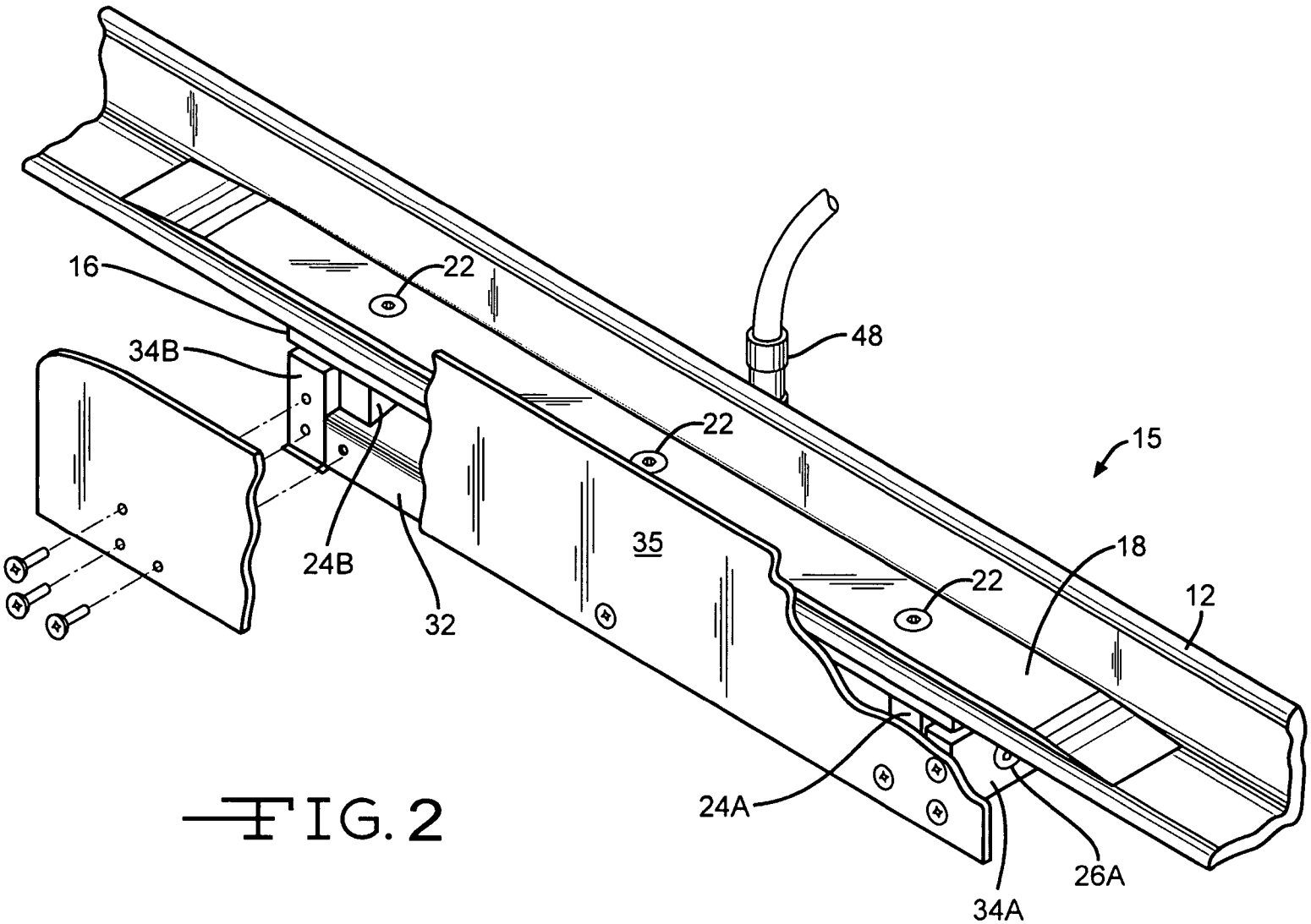
FIG. 2 presents a reverse image pictorial view of the roller monitoring device illustrated in FIG. 1.

FIG. 1 presents a pictorial view of an escalator stair-step and track assembly 10 embodying a roller monitoring device 15 attached to track 12 and embodying the present invention. Roller monitoring assembly 15 is typically positioned on the return track of the escalator unit's incline truss. Generally four roller monitoring assemblies 15 are employed on a given escalator unit, one on each of the four return roller tracks as is described further below.

Figure 3:
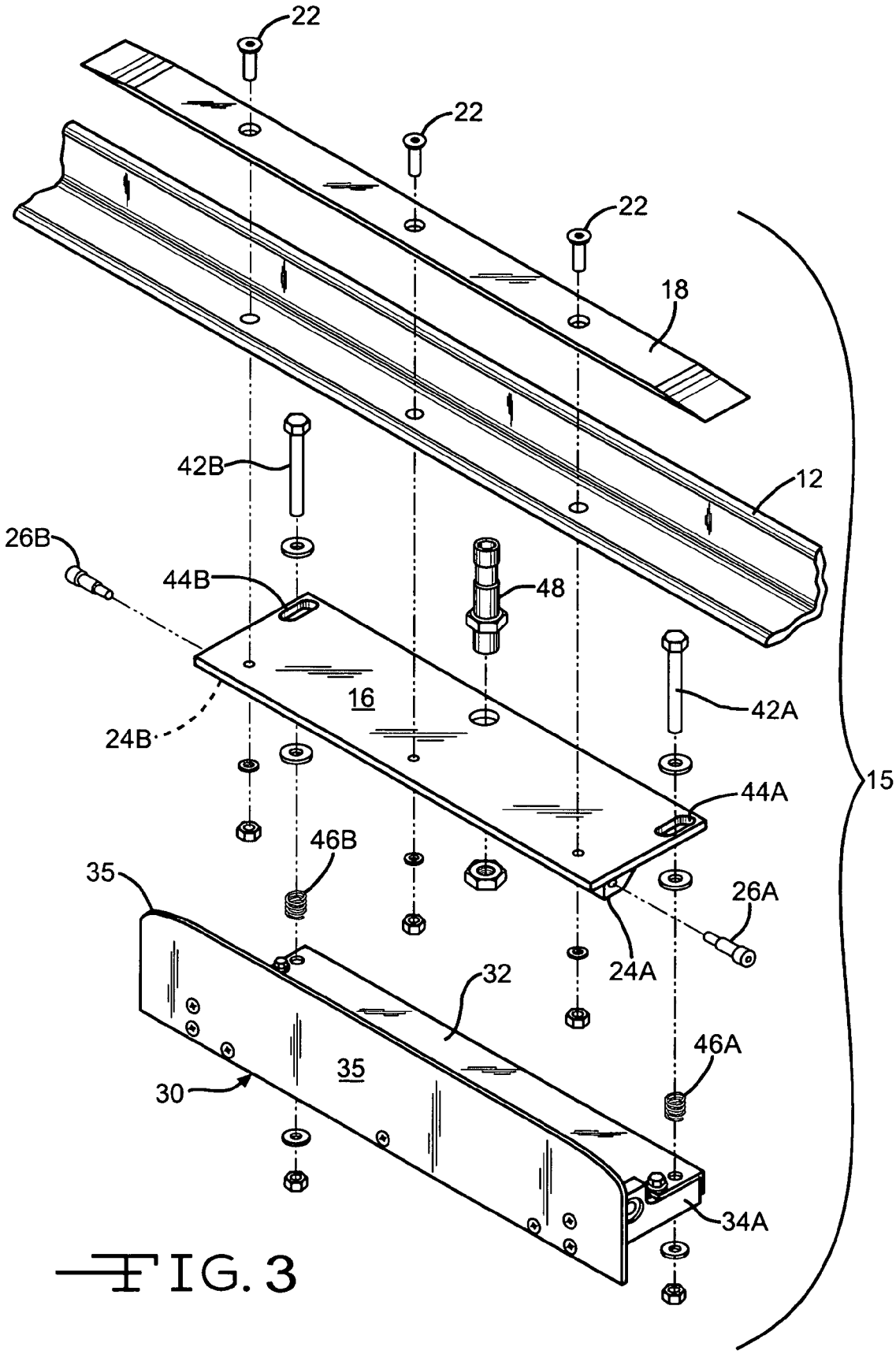
FIG. 3 presents an exploded pictorial view of the roller monitoring device as illustrated in FIG. 2 showing the individual elements of the assembly.

Additionally referring to FIGS. 2 through 5, roller monitoring assembly 15 basically comprises a mounting plate 16 rigidly affixed to the underside of track 12. Atop track 12 and opposite mounting plate 16 is a, platform, or ramp, 18, rigidly affixed atop track 12 as illustrated in the figures. The function and purpose of platform 18 is described further below. Mounting plate 16 and platform 18 may be affixed to track 12 by common fasteners 22 as best illustrated in FIG. 3. Mounting plate 16 includes, at opposite lateral ends thereof, downwardly extending bosses 24A and 24B.

Figure 4:
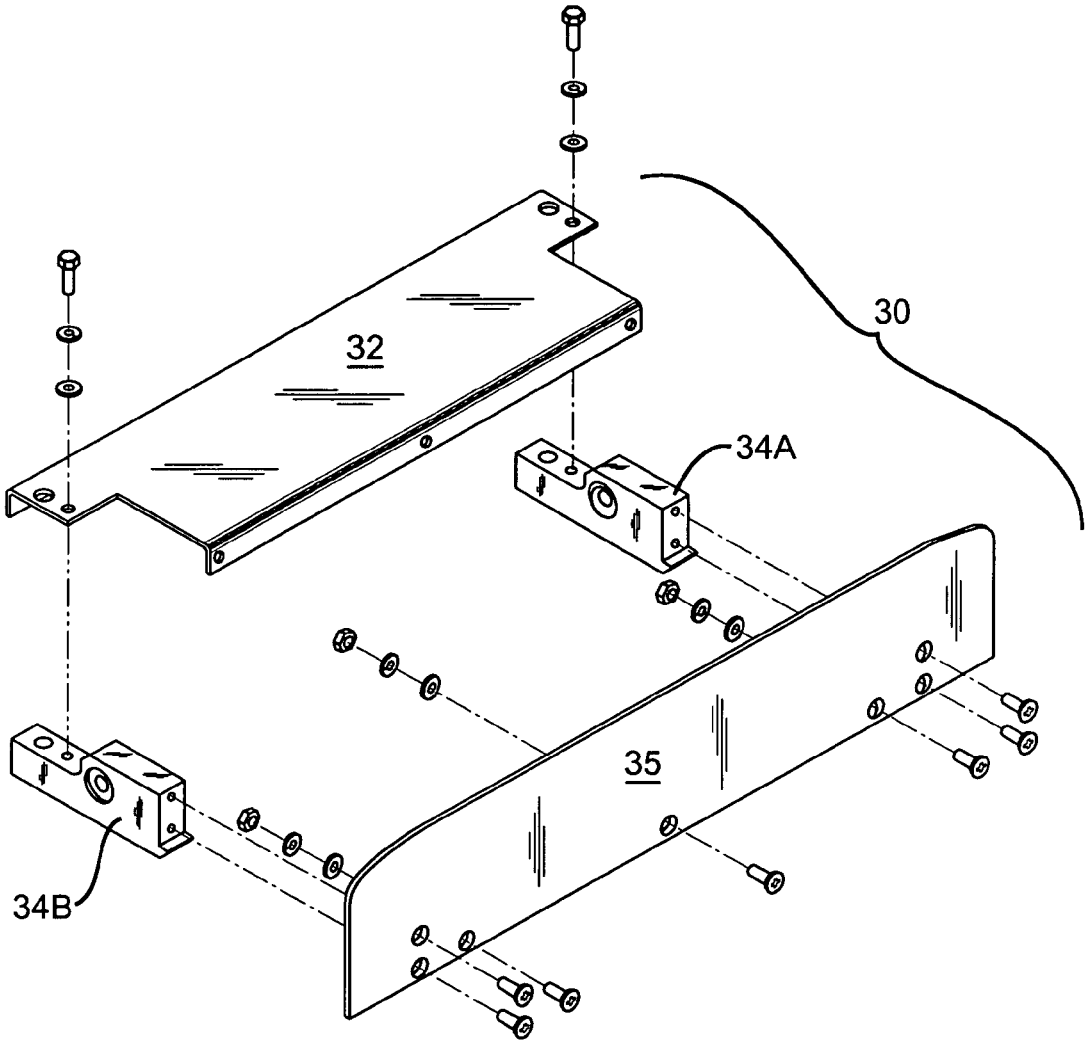
FIG. 4 presents an exploded perspective of the actuator plate subassembly.

Actuator subassembly 30 comprises a laterally elongated base plate 32 having a pair of rocker arms 34A and 34B, affixed to the underside, at opposite ends thereof as best illustrated in FIG. 4. Affixed to and extending vertically from rocker arms 34 is a generally, orthogonal actuator cam plate 35 as illustrated in the figures.

Actuator subassembly 30 is pivotally connected to mounting plate 16 by way of mounting plate bosses 24A and 24B, rocker arms 34A and 34B and pivot pins 26A and 26B.

Two elongate bolts 42A and 42B, extend through slots 44A and 44B within mounting plate 16, as illustrated in FIGS. 1 and 3, and are affixed to base plate 32 and their associated rocker arm 34A and 34B respectively. A compression spring, 46A and 46B is positioned on each bolt and between base plate 32 and mounting plate 16 as best illustrated in FIGS. 1 and 3. Compression springs 46A and 46B act to bias the actuator subassembly 30 in a clockwise direction as viewed in FIG. 5. The configuration of actuator subassembly as viewed in FIG. 5 represents the normal working configuration of actuator subassembly 30.

Figure 6:
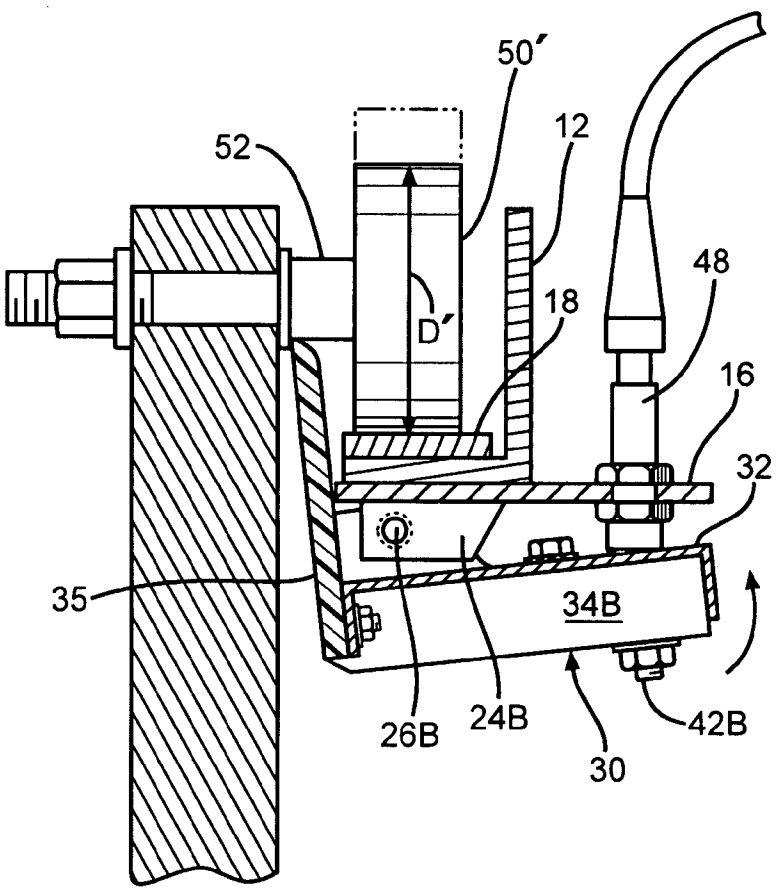
FIG. 6 presents a crossectional view, similar to that of FIG. 5, wherein the escalator roller exhibits sufficient wear to activate the roller monitoring device.
Figure 5:
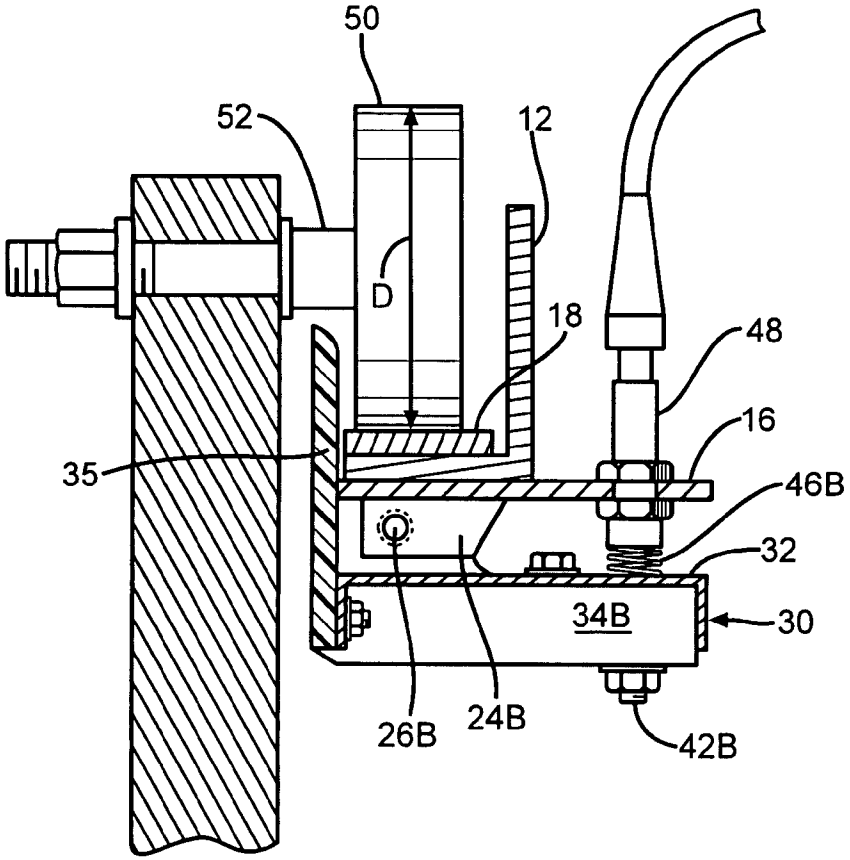
FIG. 5 presents a crossectional view taken along line 5—5 in FIG. 1 wherein the escalator roller, passing through the roller monitoring device, exhibits little or no wear.

Affixed to mounting plate 16, as best illustrated in FIGS. 1, 5 and 6, is an inductive proximity sensor 48 that senses the proximity, or non proximity, of base plate 32. Although an inductive proximity sensor is illustrated and described, it is to be understood that any other type of proximity sensor, or limit switch, might also be used.

Operation of the Escalator Roller Monitor:

Under normal operational conditions, as illustrated in FIGS. 1 and 5, escalator support roller 50, being undamaged and having an acceptable operational diameter D, enters roller monitor assembly 15 by rolling up onto platform 18 whereby axle 52 is elevated above its normal operating elevation above track 12 and passes therethrough. When, as illustrated in FIG. 5, roller 50 is of an acceptable diameter D, and has no other physical damage, axle 52, of roller 50, passes above actuator cam plate 35 making no contact therewith.

However, as illustrated in FIG. 6, if support roller 50' has a diameter D' that is less than that acceptable for further operation, because of operational wear or because of other damage such as a broken or missing roller, axle 52 will not be elevated above its normal operating level above track 12 as illustrated in FIG. 5 and will therefore engage actuator cam plate 35, as illustrated in FIG. 6, thereby forcing actuator cam plate downward and causing counter clockwise rotation of actuator subassembly 30 about pivot pins 26, whereby base plate 32, of actuator subassembly 30, is moved upward into the sensing range of inductive proximity sensor 48. Proximity sensor 48 now sends an electronic signal to the escalator controller thereby stopping the escalator until repair of the roller is accomplished.

If platform 18 were not present, the possibility would exist that if roller 50' is significantly worn, or if roller 50' is completely missing, escalator step 10 may balance itself upon the three remaining good rollers such that axle 52 would maintain its normal operating elevation above track 12 and clear actuator cam plate 35 and not activate actuator subassembly 30. To prevent this possibility, platform 18 is provided so that as roller 50, having an acceptable diameter D, enters the roller monitoring assembly 15, roller 50, will be additionally elevated approximately one eight of an inch above track 12 by platform 18. The height of axle 52 is now being measured as the height above platform 18 and not the height above track 12.

If the diameter of roller 50 is acceptable, axle 52 will be lifted up sufficiently to pass over actuator cam plate 35. However, if the roller diameter is unacceptable, axle 52 will not be elevated the additional height necessary to clear actuator plate 35 and will thereby engage actuator cam plate 35.

In the event escalator step 10 is balanced upon the remaining three acceptable rollers whereby axle 52 remains at its normal operating height above track 12, and axle 52 will not be elevated higher, as described above, and thereby axle 52 will, nevertheless, engage actuator cam plate 35 thereby causing inductor proximity sensor 48 to signal the escalator controller to stop the escalator.

Figure 7:
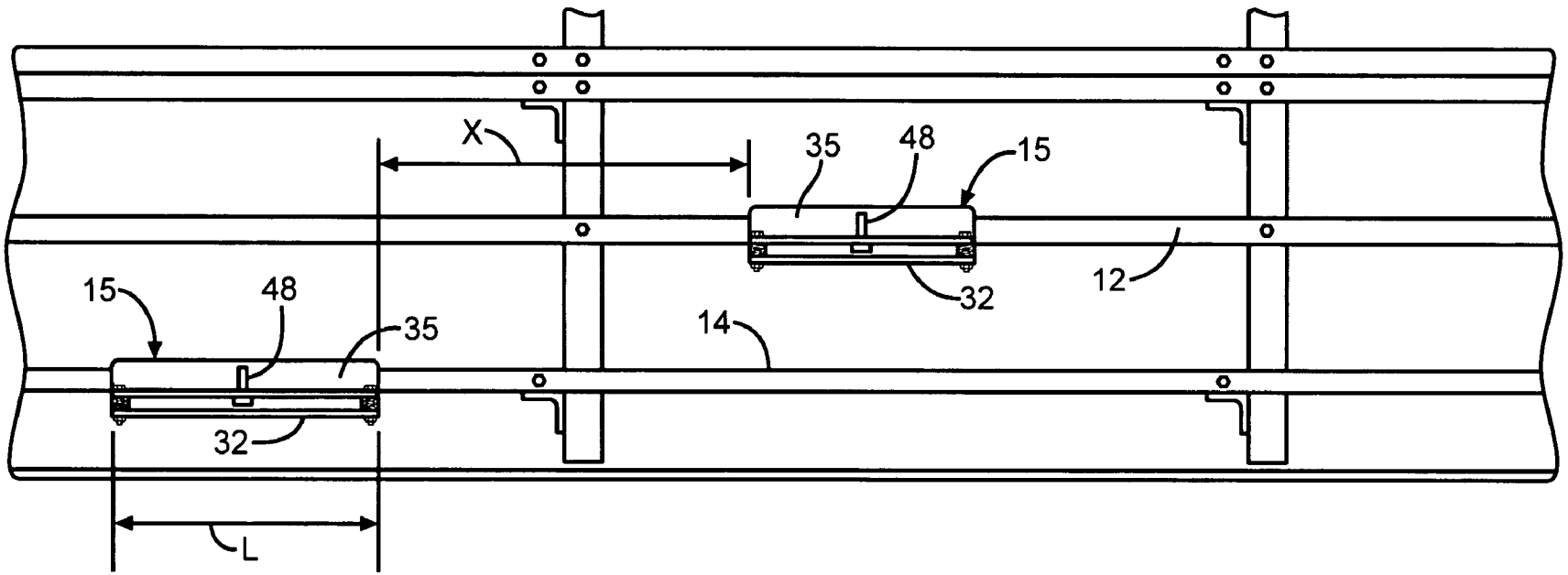
FIG. 7 presents a schematical elevation view of one side of a typical escalator roller track, or rail, system embodying the present invention.

Turning now to FIG. 7, each side of a typical escalator installation includes a step roller track 12 and a step chain roller track 14. A roller monitor assembly 15 is installed on all four roller tracks. The length L of each roller monitor assembly 15 is dependent upon the operational diameter of the rollers passing therethrough. The length L of monitor assembly 15 should be sufficiently long to permit the roller passing therethrough to, at least, make one full revolution within monitor assembly 15. Further, monitor assemblies 15, on each side of the escalator, should be separated by a distance X such that no two rollers are passing through their respective monitors at the same time.

It is to be understood that the form of the invention shown and described herein represents a best mode embodiment thereof and that various changes and modifications may be made therein by one of ordinary skill in the art without departing from the spirit or scope of the invention as described and illustrated.

We claim:

1. A mechanical inspection device attached to the return wheel track of an escalator for mechanically surveying the support wheels of an escalator stair step and identifying support wheels having an acceptable wheel diameter and support wheels having an unacceptable wheel diameter comprising:

a) a mounting plate rigidly affixed to the underside of said wheel track, b) an actuator assembly hingedly attached to said mounting plate, said actuator assembly comprising:

1) abase plate, 2) a pair of rocker arms, positioned at opposing ends of said base plate, for hingedly attaching said base plate to said mounting plate, 3) biasing means for selectively positioning said base plate relative to said mounting plate, 4) an actuator cam plate affixed to said base plate such that said cam plate extends upward towards and above said wheel track by a predetermined distance whereby the axle of said support wheel will engage said actuator plate forcing said actuator plate downward if the support wheel axle is below a predetermined distance above said wheel track, 5) sensor means associated with said mechanical inspection device such that said sensor means will cause stoppage of said escalator when said wheel axle engages said actuator plate.

2. The mechanical inspection device as claimed in claim 1 wherein said sensor means is an induction sensor that senses movement of said base plate relative to said mounting plate.

3. The mechanical inspection device as claimed in claim 1 wherein said sensor means is an induction sensor.

4. The mechanical inspection device as claimed in claim 1 wherein said sensor means is a limit switch.

5. The mechanical inspection device as claimed in claim 1 wherein said device includes a platform positioned atop said track, opposite said mounting plate, for lifting the support axle of said acceptable wheels above said actuator plate.

6. The mechanical inspection device as claimed in claim 1 wherein said biasing means comprises at least one compression spring positioned between said mounting plate and said base plate.

7. A mechanical inspection device attached to the return, wheel track of an escalator for mechanically surveying the support wheels of an escalator stair step and identifying support wheels having an acceptable wheel diameter and support wheels having an unacceptable wheel diameter comprising:

a) a mounting plate rigidly affixed to the underside of said wheel track, b) an actuator assembly hingedly attached to said mounting plate, said actuator assembly comprising:

1) a base plate, 2) hinge means for hingedly attaching said base plate to said mounting plate, 3) biasing means for positioning said base plate generally parallel to said mounting plate, 4) an actuator cam plate affixed to said base plate such that said cam plate extends upward beside and above said wheel track by a predetermined distance whereby the axle of said support wheel will engage said actuator plate forcing said actuator plate downward if the support wheel axle is below said predetermined distance, 5) sensor means positioned on said mechanical inspection device such that said sensor means will cause stoppage of said escalator when said wheel axle engages said actuator plate.

8. A method of identifying below minimum diameter support wheels of a moving escalator stair step comprising the steps of:

1) providing a track upon which said support wheels roll,
2) placing a wheel elevating platform upon a portion of said track,
3) positioning an orthogonal plate aside said track and said platform, said orthogonal plate extending above said platform by a predetermined distance,
4) causing said support wheels to roll over said platform such that the axle of said support wheels extends over said orthogonal plate whereby the axle of support wheels having an acceptable wheel diameter will pass over said orthogonal plate and wherein the axle of support wheels having an unacceptable, below minimum diameter, will engage said orthogonal plate thereby activating a control mechanism that will stop the escalator driving motor.

* * * * *